United States Patent [19]

Furuya

[11] Patent Number: 4,749,611

[45] Date of Patent: Jun. 7, 1988

[54] SCREEN FABRICS

[75] Inventor: Yozo Furuya, Tachikawa, Japan

[73] Assignee: NBC Industries Co., Ltd., Tokyo, Japan

[21] Appl. No.: 891,526

[22] Filed: Jul. 31, 1986

[30] Foreign Application Priority Data

Aug. 2, 1985 [JP] Japan ..... 60-119078

[51] Int. Cl.[4] ..... D03D 3/00

[52] U.S. Cl. ..... 428/229; 101/114; 350/322; 428/225; 428/364; 428/372; 428/395; 428/901

[58] Field of Search ..... 428/364, 372, 225, 229, 428/395, 901; 101/114; 350/322

[56] References Cited

U.S. PATENT DOCUMENTS 4,283,452 8/1981 Marco ..... 428/253

*Primary Examiner*—James J. Bell

*Attorney, Agent, or Firm*—Frishauf, Holtz, Goodman & Woodward

[57] ABSTRACT

The screen fabric woven of synthetic fibers such as polyester monofilament and polyamide monofilament for preparing the stencil. The synthetic fiber has colored transparency and 0.01 to 0.1 weight percent of titanium dioxide as well as 0.5 to 1.0 weight percent of ultraviolet absorber and pigment are added thereto for preventing halation during exposure treatment process.

20 Claims, 4 Drawing Sheets

SCREEN FABRICS

BACKGROUND OF THE INVENTION

This invention relates to a screen fabric for use in preparing a stencil which is used for screen printing, textile printing or fabrication of printed circuits.

The stencil for screen printing is, for instance, prepared in accordance with the following processes.

(1) Fabrication of Fiber
(2) Wrapping
(3) Weaving
(4) Heat Set
(5) Stretching
(6) Forming of Photosensitive Layer by Coating of Photosensitized Emulsion or Adhering of Photosensitive Film
(7) Pattern Exposure
(8) Washout
(9) Drying The fabric is generally prepared to be 100 to 500 meshes when a polyester monofilament is utilized as a material fiber.

In preparing a screen fabric, however, there is a problem to be overcome, which is the peeling off of the scum caused by repeatedly receiving the frictional force during the fabrication process, expecially weaving process thereof. Further, in preparing a stencil, there is also a problem to be overcome, which is the occurance of the so-called "halation", that is the phenomena that the fabric is photosensitized over the predetermined area by the reflection light, which is caused during the pattern exposure process therefor.

When the amount of the peeling off of the scum is excessive, a weaving reed becomes dirty and the fabric is blocked with scum and fibril, which resulting in such troubles as fiber breaking and/or getting dirty of grey goods, so that it becomes difficult to obtain the desired length fabric and the working efficiency becomes remarkably low.

Further, when the halation occurs, not only the quality of the stencil becomes remarkably low but also the precise printing of the printed circuit board becomes difficult.

In order to prevent the peeling off of the scum, the monofilament shall have low content of delustering agents such as titanium dioxide. On the contrary, in order to prevent the occurrence of the halation, it is effective to have high content of the delustering agents in the material fabric. In this connection, in the prior art fabric, the monofilament in semi-dull polymer state having the content of 0.3 to 0.6 weight percent titanium dioxide is generally utilized. However, with the above prior monofilament, it has been difficult to desirably prevent the occurrence of the halation.

Under this circumstance, as it is said that the occurrence of the halation can be prevented when the light reflection ratio is less than 20 percent, it has been proposed to have a fiber dyed in yellow or the like color (Prior Art A). With this prior art A, as indicated by A in FIG. 1, the reflection ratio thereof is less than 20 percent in every light wave length area. The tested sample of the prior art A was prepared with the monofilament including 0.5 weight percent of the titanium dioxide and dyed with the yellow or the like pigment.

Meanwhile, the light of wave length 340–440 nm (hereinafter called exposure light wave length area) is generally utilized to photo-sensitize the screen fabric.

With the above prior art A, however, since such high content of the titanium dioxide as 0.3 to 0.6 weight percent is included in the material fiber, the light transparency level becomes low and the patterns can not be so exposed as the rear side of the fabric is sensitized, and there is a possibility that the surface is worn off from the stencil during printing operations. Accordingly, it becomes necessary to twice expose the pattern on the fabric from the front and rear sides thereof. Further, as the titanium dioxide included in the fibers is partly protruded out of the surface thereof, there remains the defects caused by the peeling off of the scum, abrasion of weaving loom parts, inappropriate ink releasing and so on.

In order to dissolve the above defects of the prior art A, a fiber which does not include the titanium dioxide at all has then been proposed (Prior Art B). This fiber comprises Polyethylene Terephthalates base-polymer contained ultraviolet absorbers therein so as to prevent the occurrence of halation by the contained ultraviolet absorbers. With this prior art B, however, as also indicated in FIG. 1, the light reflection ratio thereof exceeds 20 percent in the visible ray area. As the exposure light wave length area of 340–440 nm includes not only the ultraviolet ray but also the visible ray. Accordingly, it is difficult to prevent the occurrence of the halation in its visible ray area. Further, as the large amount of ultraviolet absorbers is added so as to try to prevent the occurrence of the halation only by the ultraviolet absorbers, it results in increasing of costs, falling down of the quality of the fabric and decreasing of the printing life.

SUMMARY OF THE INVENTION

Accordingly, it is an object of the present invention to provide an improved screen fabric capable of eliminating the above defects of the prior art.

For this purpose, according to this invention, the screen fabric is woven of synthetic fibers such as polyester monofilament and polyamide monofilament, said synthetic fiber having colored transparency, and 0.01 to 0.1 weight percent of titanium dioxide as well as 0.5 to 1.0 weight percent of ultraviolet absorber and pigment are added thereto.

With the present invention, the occurrence of the halation is substantially prevented without double exposure, as well as preventing the peeling off of the scum, the abrasion of weaving loom parts, inappropriate ink releasing, falling down of the quality of the fiber and decreasing of the printing life.

BRIEF DESCRIPTION OF THE ACCOMPANYING DRAWINGS

Figure 3:
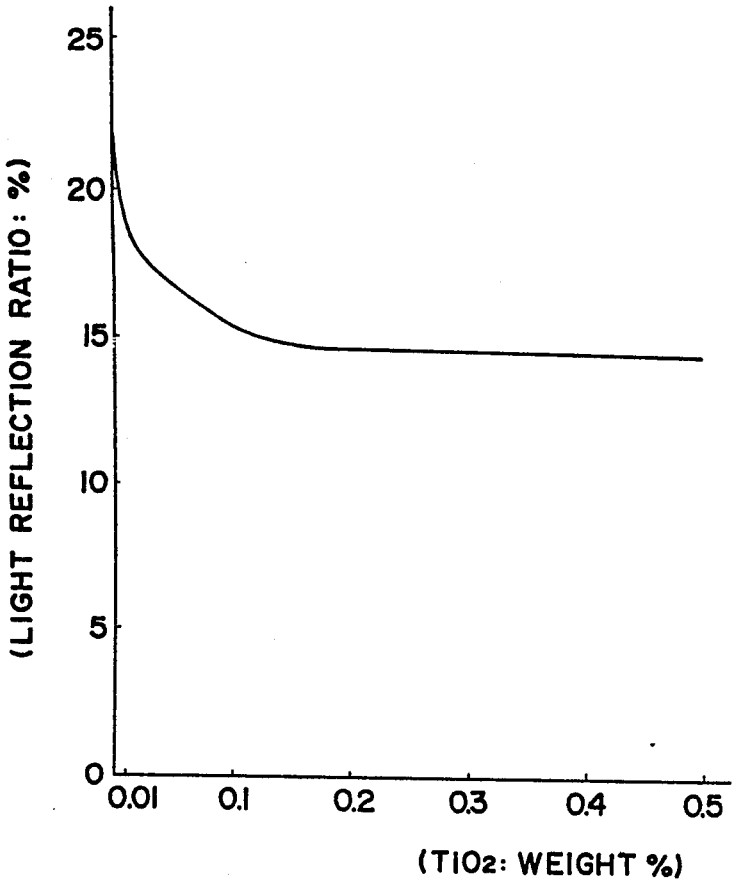
Figure 4:
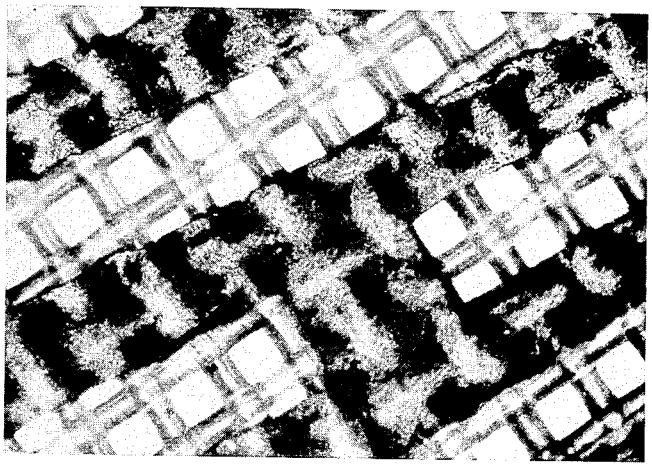
Figure 5:
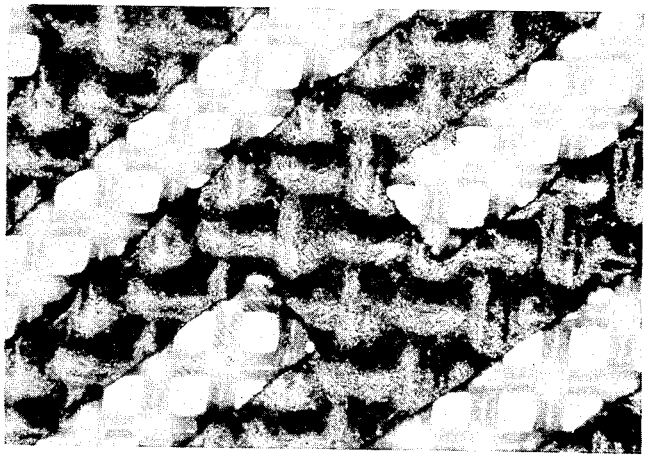

FIG. 3 shows the variation of the light reflection ratio, in the most appropriate light wave length, i.e. 375 nm, of the sample which includes ultraviolet absorbers and pigments, the total weight percent of which is 0.5, and wherein the content of titanium dioxide changes ; and FIGS. 4 and 5 are micrographs showing the stencil prepared by the monofilament of the present invention (FIG. 4) and by the prior art monofilament (FIG. 5).

DESCRIPTION OF THE PREFERRED EMBODIMENT

Figure 1:
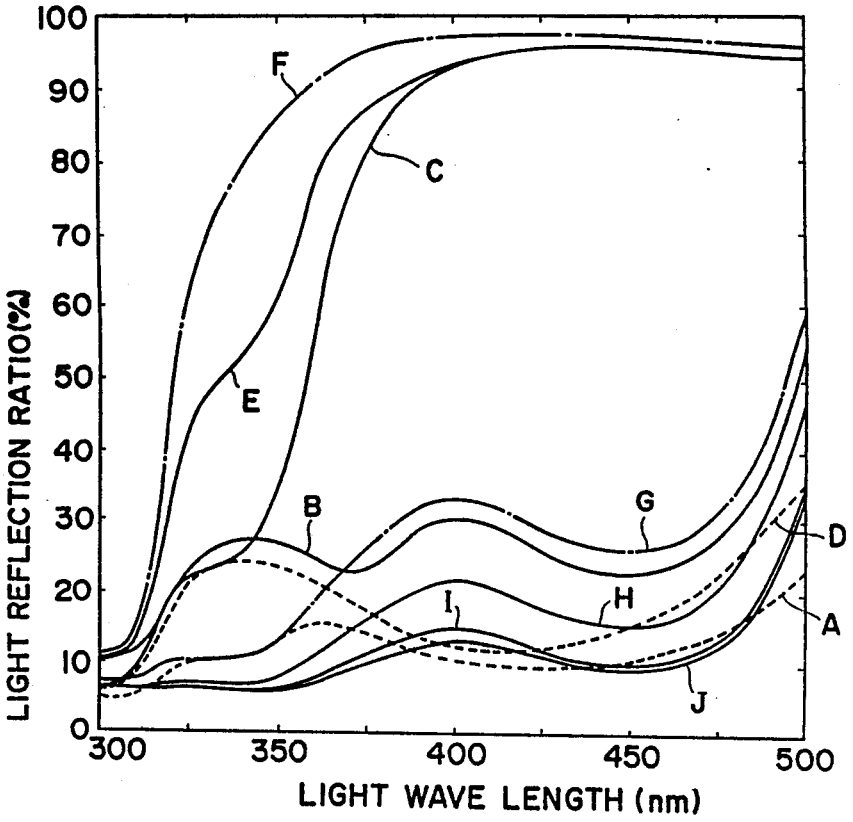
FIG. 1 shows the light reflection ratio of the various monofilaments used to prepare the screen fabric, wherein A and B indicate prior art samples, C through G comparative samples and H through J the samples of the present invention.

The various samples have been prepared and their light reflection ratios have been tested, the results of which are indicated in FIG. 1. In FIG. 1, the curve C shows the result of the sample comprising the monofilament in semi-dulled polymer including 0.5 weight percent of the titanium dioxide; D the sample including 0.1 weight percent of the titanium dioxide and yellow or the like pigment; E the sample including 0.1 weight percent of the titanium dioxide; F the sample not-including the titanium dioxide at all; and G the sample including 0.1 weight percent of the titanium dioxide and 0.5 weight percent of the ultraviolet absorbers. Furthermore, the curve H indicates the test results of the sample which includes 0.1 weight percent of the titanium dioxide and 0.5 weight percent of the ultraviolet absorbers and the pigment; I the sample including 0.1 weight percent of the titanium dioxide and 0.75 weight percent of the ultraviolet absorbers and the pigments; J the sample including 0.1 weight percent of the titanium dioxide and 0.1 weight percent of the ultraviolet absorbers and the pigments. The pigments utilized are yellow or the like ones, and pale in H, intermediate in I and dark in J while all are transparent.

The screen fabric embodying the invention is woven by synthetic fibers such as polyester monofilament, polyamide monofilament and so on. Further, titanium dioxide, ultraviolet absorbers and pigments have been added to the materials of synthetic fibers. The content of titanium dioxide is 0.01–0.1 weight percent, and the total contents of ultraviolet absorbers and pigments are 0.5–1.0 weight percent.

The diameter of the monofilament is about 30–100 microns. The weaving way can be selected from plain weaving and twill weaving. In cast of twill weaving, 2/1 twill weaving , 2/2 twill weaving and other kinds of twill weaving can be choiced.

The reason why setting the upper limit of the content of the titanium dioxide to 0.1 weight percent is, because it has been learned from the experiences that, with the content of this level of the titanium dioxide, the transparency of the fiber obtained is not affected and the light permeability thereof is well so that it becomes possible to sensitize the fabric to the rear side thereof and also the wearing off of the surface of the stencil during printing operations can be prevented. Further, as the titanium dioxide does not partly protrude out of the surface of the fiber, the peeling off of the scum, abrasion of the weaving loom parts, inappropriate ink releasing do not occur.

When the titanium dioxide exceeds 0.1 weight percent, however, as indicated by the curve E in FIG. 1, the reflection ratio exceeds 20 percent in all exposure light wave length areas and therefore the halation occurs, so that it cannot be used as fibers of a screen fabric.

Further, when the pigment is added while the content of the titanium dioxide is 0.1 weight percent, the light reflection ratio exceeds 20 percent, as indicated by the curve D in FIG. 1, in the exposure light wave length area of less than 365 nm. Moreover, when the ultraviolet absorber is added while the content of the titanium dioxide is 0.1 weight percent, the light reflection ratio exceeds 20 percent, as indicated by the curve G in FIG. 1, in the exposure light wave length area of more than 362 nm. Accordingly, the above two can not be used as a screen fabric.

Figure 2:
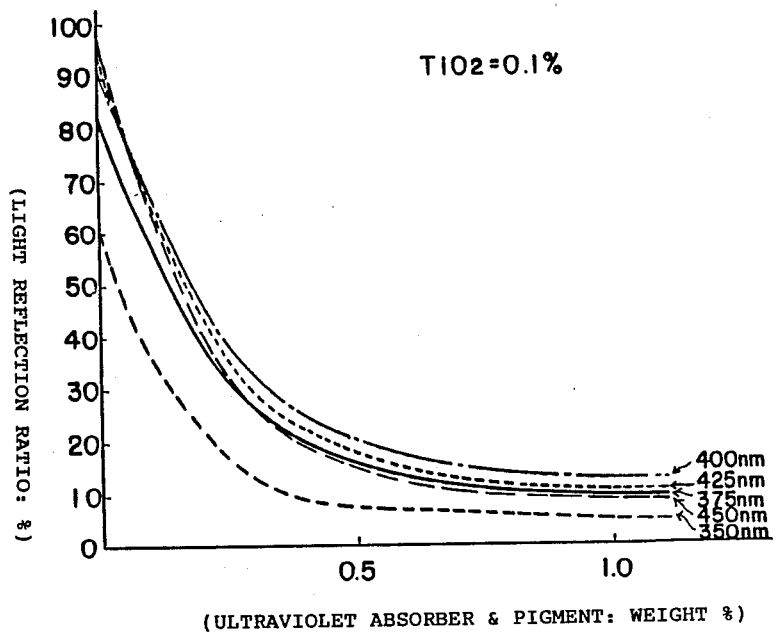
FIG. 2 shows the light reflection ratio of the sample which includes ultraviolet absorbers, pigments and 0.1 weight percent of titanium dioxide.

Then, the light reflection ratios in various light wave length areas have been tested with the sample wherein 0.1 weight percent of the titanium dioxide, the ultraviolet absorbers and the pigments are included, the results of which are indicated in FIG. 2. From the results thereof, the upper and lower limits of the contents of the ultraviolet absorbers and the pigments have been determined. That is, the lower limit thereof must be 0.5 weight percent as the light reflection ratio in the light wave length area of 400 nm exceeds 20 percent when the content thereof is less than 0.5 weight percent. On the contrary, when the content thereof exceeds 1.0 weight percent, the light reflection ratio becomes stable in condition of less than 20 percent. As above explained, in order to give the fabric good transparency, the content of the ultraviolet absorbers and the pigments should be so decreased as possible. Accordingly, the upper limit of the content thereof must be set to 1.0 weight percent.

The ratio between the ultraviolet absorbers and the pigments is better to set better 3:1 to 2:2 since the pigments are foreign subjects against the fiber and it becomes difficult to form the fiber as having round section when large amounts of the pigments are added to the materials thereof.

Then, the light reflection ratio of the sample containing 0.5 weight percent of the ultraviolet absorbers and the pigments has been tested at the most appropriate light wave length, i.e. 375 nm by varying the amount of the titanium dioxide, the result of which is indicated in FIG. 3. From the result thereof, when the titanium dioxide is not contained at all, the light reflection ratio exceeds 20 percent so that it can not be used as a material fiber. However, when the very small amount of the titanium dioxide is added, for instance, 0.01 weight percent, the light reflection ratio is suddenly decreased to the level less than 20 percent. Accordingly, the lower limit of the amount of the titanium dioxide has been set to 0.01 weight percent.

From the above results, it has been found, additionally, that the light reflection ratio becomes stable when the amount of the titanium dioxide exceeds 0.1 weight percent while the light reflection ratio is suddenly decreased during the range of the amount of the titanium dioxide from 0 to 0.1 weight percent. It means that, in order to prevent the occurrence of the halation, it is sufficient to add 0.1 weight percent of the titanium dioxide to the material when 0.5 weight percent of the ultraviolet absorbers and the pigments are added thereto.

As the ultraviolet absorbers, Benztriazole group substance such as 2-(2-hydroxy-5-methyl-phenyl)-2H-Benztriazole and 2-(2-hydroxy-3-tri-Butyl-5-methyl-phenyl)-5-chloro-benztriazole, or Benzphenone group substance such as 5-5-methylene-vis(2-hydroxy-4-methoxy) Benzphenone and so on can be utilized. The ultraviolet absorber utilized in the above tested samples is MARK LA-51 (Trademark) produced by ADEKA ARGUS CHEMICAL CO., LTD.

As the pigments, yellow or the like or red or the like ones are suitable, since the prevention of the halation with the pigments means the absorption of the reflection light with the pigments. In other words, when the material fiber is colored by the above color pigment, the complementary color thereof such as purple or the like or blue or the like, the light wave length of which is about 400 to 450 nm, is absorbed by the pigments. The ultraviolet absorbers and the pigments are added to the materials of the fiber before fabricating the fiber so that the fabrics can be spun dyed and the independent dyeing process therefor can be omitted.

The stencil prepared with the fabric embodying the invention is not affected by the halation as seen from the micrograph shown in FIG. 4, which is more easily understandable when compared with the micrograph shown in FIG. 5 wherein the subject stencil was prepared with the prior art fabric. In the latter one, the fibers existing at the pattern edge have been exposed, while in the former one the fibers existing at the pattern edge have not been exposed at all, which means that the occurrence of the halation has been prevented.

The process for preparing the stencil are exactly the same as aforementioned relating to the prior arts.

What we claim is:

1. A screen fabric prepared from colored synthetic transparent monofilament fibers, said fibers comprising a synthetic fiber forming material, 0.01 to 0.1 weight % of titanium dioxide and a total content of 0.5 to 1.0 weight % of ultraviolet absorber and colored pigment.

2. The screen fabric of claim 1 wherein said synthetic fiber forming material is a polyester or a polyamide.

3. The screen fabric of claim 1 wherein said synthetic fiber forming material is a polyester.

4. The screen fabric of claim 1 wherein said synthetic fiber forming material is a polyamide.

5. The screen fabric of claim 2 wherein the diameter of said monofilament is about 30–100 microns.

6. The screen fabric of claim 2 wherein the ratio of said ultraviolet absorber to pigment is 2:2 to 3:1.

7. The screen fabric of claim 2 wherein said ultraviolet absorber is selected from the group consisting of 2-(2-hydroxy-5-methyl-phenyl)-2H-benztriazole, 2-(2-hydroxy-3-tri-butyl-5-methyl-phenyl)-5-chloro-benztriazole and 5-5-methylene-bis(2-hydroxy-4-methoxy)-benzphenone.

8. The screen fabric of claim 2 wherein said pigment is a yellow or red pigment.

9. The screen fabric of claim 5 wherein the ratio of said ultraviolet absorber of pigment is 2:2 to 3:1.

10. The screen fabric of claim 9 wherein said pigment is a yellow or red pigment, and said ultraviolet absorber is selected from the group consisting of 2-(2-hydroxy-5-methyl-phenyl)-2H-benztriazole, 2-(2-hydroxy-3-tri-butyl-5-methyl-phenyl)-5-chloro-benztriazole and 5-5-methylene-bis(2-hydroxy-4-methoxy)benzphenone.

11. A colored synthetic transparent monofilament fiber comprising a synthetic fiber forming material, 0.01 to 0.1 weight % of titanium dioxide and a total content of 0.5 to 1.0 weight % of ultraviolet absorber and colored pigment.

12. The fiber of claim 11 wherein said synthetic fiber forming material is a polyester or a polyamide.

13. The fiber of claim 11 wherein said synthetic fiber forming material is a polyester.

14. The fiber of claim 11 wherein said synthetic fiber forming material is a polyamide.

15. The fiber of claim 12 wherein the diameter of the monofilament is about 30–100 microns.

16. The fiber of claim 12 wherein the ratio of said ultraviolet absorber to pigment is 2:2 to 3:1.

17. The fiber according to claim 12 wherein said ultraviolet absorber is selected from the group consisting of 2-(2-hydroxy-5-methyl-phenyl)-2H-benztriazole,2-(2-hydroxy-3-tri-butyl-5-methyl-phenyl)-5-chloro-benztriazole and 5-5-methylene-bis(2-hydroxy-4-methoxy)-benzphenone.

18. The fiber of claim 12 wherein said pigment is a yellow or red pigment.

19. The fiber of claim 15 wherein the ratio of said ultraviolet absorber to pigment is 2:2 to 3:1.

20. The fiber of claim 19 wherein said pigment is a yellow or red pigment, and said ultraviolet absorber is selected from the group consisting of 2-(2-hydroxy-5-methyl-phenyl)-2H-benztriazole, 2-(2-hydroxy-3-tri-butyl-5-methyl-phenyl)-5-chloro-benztriazole and 5-5-methylene-bis(2-hydrox-4-methoxy)benzphenone.

* * * * *